US006964792B1

(12) United States Patent
Mayer et al.

(10) Patent No.: US 6,964,792 B1
(45) Date of Patent: Nov. 15, 2005

(54) METHODS AND APPARATUS FOR CONTROLLING ELECTROLYTE FLOW FOR UNIFORM PLATING

(75) Inventors: Steven T. Mayer, Lake Oswego, OR (US); R. Marshall Stowell, West Linn, OR (US); Evan E. Patton, Portland, OR (US); Seshasayee Varadarajan, Wilsonville, OR (US)

(73) Assignee: Novellus Systems, Inc., San Jose, CA (US)

( * ) Notice: Subject to any disclaimer, the term of this patent is extended or adjusted under 35 U.S.C. 154(b) by 648 days.

(21) Appl. No.: 09/927,740

(22) Filed: Aug. 10, 2001

Related U.S. Application Data

(63) Continuation-in-part of application No. 09/706,272, filed on Nov. 3, 2000, now Pat. No. 6,527,920.
(60) Provisional application No. 60/295,116, filed on May 31, 2001.

(51) Int. Cl.[7] ..... B05C 3/00; B05D 1/18; C25D 5/00; C25D 17/00

(52) U.S. Cl. ..... 427/430.1; 205/137; 205/148; 204/263; 204/264; 204/266; 204/212; 118/410; 118/416

(58) Field of Search ..... 204/263, 264, 204/266, 295–296, 282, 212; 205/148, 137; 118/410, 416; 427/430.1

(56) References Cited

U.S. PATENT DOCUMENTS 5,221,449 A 6/1993 Colgan et al.
5,281,485 A 1/1994 Colgan et al.
5,482,611 A 1/1996 Helmer et al.
5,985,762 A 11/1999 Geffken et al.
6,074,544 A 6/2000 Reid et al.
6,099,702 A 8/2000 Reid et al.
6,110,346 A 8/2000 Reid et al.
6,124,203 A 9/2000 Joo et al.
6,126,798 A 10/2000 Reid et al.
6,139,712 A 10/2000 Patton et al.
6,156,167 A 12/2000 Patton et al.
6,159,354 A 12/2000 Contolini et al.
6,162,344 A 12/2000 Reid et al.
6,179,973 B1 1/2001 Lai et al.
6,179,983 B1 1/2001 Reid et al.
6,193,854 B1 2/2001 Lai et al.
6,217,716 B1 4/2001 Fai Lai
6,221,757 B1 4/2001 Schmidbauer et al.
6,251,242 B1 6/2001 Fu et al.
6,274,008 B1 8/2001 Gopalraja et al.
6,277,249 B1 8/2001 Gopalraja et al.
6,503,376 B2 * 1/2003 Toyoda et al. ..... 204/252
2002/0029973 A1 * 3/2002 Maydan ..... 205/96

* cited by examiner

*Primary Examiner*—Donald R. Valentine
(74) *Attorney, Agent, or Firm*—Beyer, Weaver & Thomas, LLP.

(57) ABSTRACT

The present invention provides apparatus and methods for controlling flow dynamics of a plating fluid during a plating process. The invention achieves this fluid control through use of a diffuser membrane. Plating fluid is pumped through the membrane; the design and characteristics of the membrane provide a uniform flow pattern to the plating fluid exiting the membrane. Thus a work piece, upon which a metal or other conductive material is to be deposited, is exposed to a uniform flow of plating fluid.

58 Claims, 10 Drawing Sheets

METHODS AND APPARATUS FOR CONTROLLING ELECTROLYTE FLOW FOR UNIFORM PLATING

CROSS-REFERENCE TO RELATED APPLICATIONS

This application claims priority under 35 USC 119(e) from U.S. Provisional Patent Application No. 60/295,116 naming Mayer et al. as inventors, titled "Methods and Apparatus for Controlling Electrolyte Flow for Uniform Plating," filed May 31, 2001; this application is a continuation-in-part claiming priority under 35 USC 120 from U.S. patent application No. 09/706,272 filed Nov. 3, 2000 now U.S. Pat. No. 6,527,920, naming Mayer et al. as inventors, and titled "Copper Electroplating Method an Apparatus," both of which are incorporated herein by reference in their entirety for all purposes. This application is also related to the following U.S. Patent Applications: U.S. Provisional Patent Application No. 60/295,245 naming Jonathan Reid, Steven Mayer, Marshall Stowell, Evan Patton, and Jeff Hawkins as inventors, titled "Improved Clamshell Apparatus for Electrochemically Treating Wafers," and filed May 31, 2001; U.S. patent application No. 09/872,340 naming Evan Patton, David Smith, Jonathan Reid, and Steven Mayer as inventors, titled "Methods and Apparatus for Bubble Removal in Wafer Wet Processing," and filed May 31, 2001; and U.S. patent application Ser. No. 09/872,341 naming Jonathan Reid, Evan E. Patton, Dinesh Kalakkad, Steven Mayer, David Smith, Seshasayee Varadarajan, and Gary Lind as inventors, titled "Methods and Apparatus for Controlled Angle Wafer Immersion," and filed May 31, 2001 now U.S. Pat. No. 6,551,487. Each of these applications is incorporated herein by reference in its entirety and for all purposes.

FIELD OF THE INVENTION

This invention relates to plating technology. More specifically, it relates to silicon wafer plating technology. Even more specifically, the invention pertains to particular apparatus and methods for controlling plating solution flow dynamics during wafer plating for more uniform and higher quality plating.

BACKGROUND OF THE INVENTION

Electroplating has many applications. One very important developing application is in plating copper onto semiconductor wafers to form conductive copper lines for "wiring" individual devices of the integrated circuit. Often this plating process serves as a step in the damascene fabrication procedure.

A continuing issue in modern VLSI wafer electroplate processing is quality of the deposited metal film. Given that metal line widths reach into the deep sub-micron range and given that the damascene trenches often have very high aspect ratios, electroplated films must be exceedingly homogeneous (chemically and physically). They must have uniform thickness over the face of a wafer and must have consistent quality across numerous batches.

Some wafer processing apparatus are designed to provide the necessary uniformity. One example is the SABRE™ clamshell electroplating apparatus available from Novellus Systems, Inc. of San Jose, Calif. and described in U.S. Pat. Nos. 6,156,167 and 6,139,712, which are herein incorporated by reference in their entireties. The clamshell apparatus provides many advantages for wafer throughput and uniformity; most notably, wafer back-side protection from contamination during electroplating, wafer rotation during the electroplating process, and a relatively small footprint for wafer delivery to the electroplating bath (vertical immersion path).

Modifications to the "clamshell" and its associated plating environment for improved wafer uniformity and quality have been described in U.S. Pat. Nos. 6,074,544, 6,110,346, 6,162,344, and 6,159,354 which are herein incorporated by reference in their entireties. The described modifications relate to methods for using variable currents, improved mass transfer, electric potential shaping, and the like.

Although plating quality continues to improve with developments such as those described in the above patents, there is a continuing need for improved uniformity and consequent higher plating quality. The local environment seen by the wafer during plating drives the deposited layer uniformity. Plating solution flow patterns, bubbles, electric field shape, and the like all affect the quality of the deposited metal film. One issue of particular importance is the electrolyte velocity distribution across the wafer surface, particularly the distribution of the component normal to the wafer surface. For many combinations of apparatus and operating conditions, the electrolyte velocity varies significantly in the radial direction across the wafer surface. Because the plating rate and quality is a function of local velocity, this condition causes uneven plating thickness and/or quality.

With the deleterious effects of uneven plating solution flow patterns in mind, tighter control of certain design parameters should be realized. What is needed therefore is improved technology for controlling plating solution flow dynamics with respect to the wafer surface during electroplating.

SUMMARY OF THE INVENTION

The present invention provides apparatus and methods for controlling flow dynamics of a plating fluid during a plating process. More particularly, the invention provides methods and apparatus for controlling plating fluid flow dynamics with respect to a plating surface of a substrate.

The invention achieves this fluid control through use of a diffuser membrane. Plating fluid is driven through the membrane by forced convection; the design and characteristics of the membrane provide a uniform flow pattern to the plating fluid exiting the membrane. Thus a substrate, upon which a metal or other conductive material is to be deposited, is exposed to a uniform flow of plating fluid.

The distribution of the axial component of fluid velocity on the plating surface of a wafer is primarily important to plating uniformity. This invention controls fluid dynamics to improve film uniformity and quality. Thus, the invention provides a uniform flow of plating fluid to the plating surface of a wafer. A uniform flow in this context means a substantially uniform velocity profile across the surface of a diffuser membrane. Thus in one embodiment, a uniform flow is directed at a wafer surface along an orthogonal trajectory. Such flow patterns have been found to improve plated film quality. Particular embodiments of the invention also provide adventitious removal of bubbles and filtration of particulates, also giving improved film uniformity and quality.

In one aspect, the invention can be described in terms of an apparatus for electroplating a metal onto a substrate, the apparatus comprising: a cathode electrical connection that can connect to the substrate and apply a potential allowing the substrate to become a cathode; an anode electrical connection that can connect to an anode and apply an anodic potential to the anode; and anode cup having the anode therein and connected to said anode electrical connection; and a diffuser membrane covering the opening of the anode cup and defining an anode compartment; wherein a plating fluid is first pumped into said anode compartment through an aperture and the plating fluid must flow through said diffuser membrane before exiting the anode compartment in order to contact the substrate; the diffuser membrane creating a flow such that the plating fluid exits the diffuser membrane at substantially the same velocity across the entire surface of the diffuser membrane.

Parameters, which effect the flow rate and performance of the diffuser membrane, are the material used to construct the membrane, the rate at which the plating fluid is pumped into the anode compartment, membrane design, aperture design, chamber design, and the like. Each of these will be described in more detail below.

Generally, such an electroplating apparatus further comprises a mechanism for holding a planar plating surface of the substrate parallel to the diffuser membrane during plating, and optionally rotating the substrate along an axis normal to the plating surface. More particularly, a wafer can be held parallel to the diffuser membrane during plating or not, depending on the embodiment. In one embodiment, the diffuser membrane is in a tilted orientation with respect to a plane defining the surface of plating fluid in a bath that contains the anode compartment. Thus, the mechanism for holding a wafer parallel to the diffuser membrane during plating can tilt the wafer appropriately. The tilting mechanism can tilt the wafer at any time while it is in the wafer holder; that is, prior to immersion, during immersion, during plating, during extraction, or after extraction from the plating solution.

The aforementioned electroplating apparatus can further comprise a porous transport barrier. This barrier is preferably between the anode and the diffuser membrane, thus defining an anode chamber between the anode and the transport barrier and a diffuser chamber between the diffuser membrane and the transport barrier. In certain embodiments, the porous transport barrier allows migration of ionic species, including metal ions, between the anode and diffuser chambers, while substantially preventing non-ionic organic bath additives from entering into the anode chamber. In other embodiments, the transport barrier comprises a simple porous membrane filter that allows fluid flow but prevents particulate movement between the anode chamber and the diffuser chamber. When the transport barrier is used, the total flow of plating fluid is divided appropriately between the anode and diffuser chambers of the anode compartment.

In another aspect the invention is a method for providing a substantially uniform flow of a plating fluid to the plating surface of a wafer during plating, the method comprising: providing a compartment fitted with a diffuser membrane; pumping the plating fluid into said compartment such that the plating fluid exits the compartment through the diffuser membrane at substantially the same velocity across the entire surface of the diffuser membrane; and holding the plating surface of the wafer in close proximity to the diffuser membrane during plating. Thus, in this aspect the invention can be used for electroless or electroplating applications. Preferably, the compartment is an anode compartment and electroplating is the plating method used.

These and other features and advantages of the present invention will be described in more detail below with reference to the associated figures.

BRIEF DESCRIPTION OF THE DRAWINGS

The following detailed description can be more fully understood when considered in conjunction with the drawings in which.

DETAILED DESCRIPTION OF THE PREFERRED EMBODIMENTS

Figure 1:
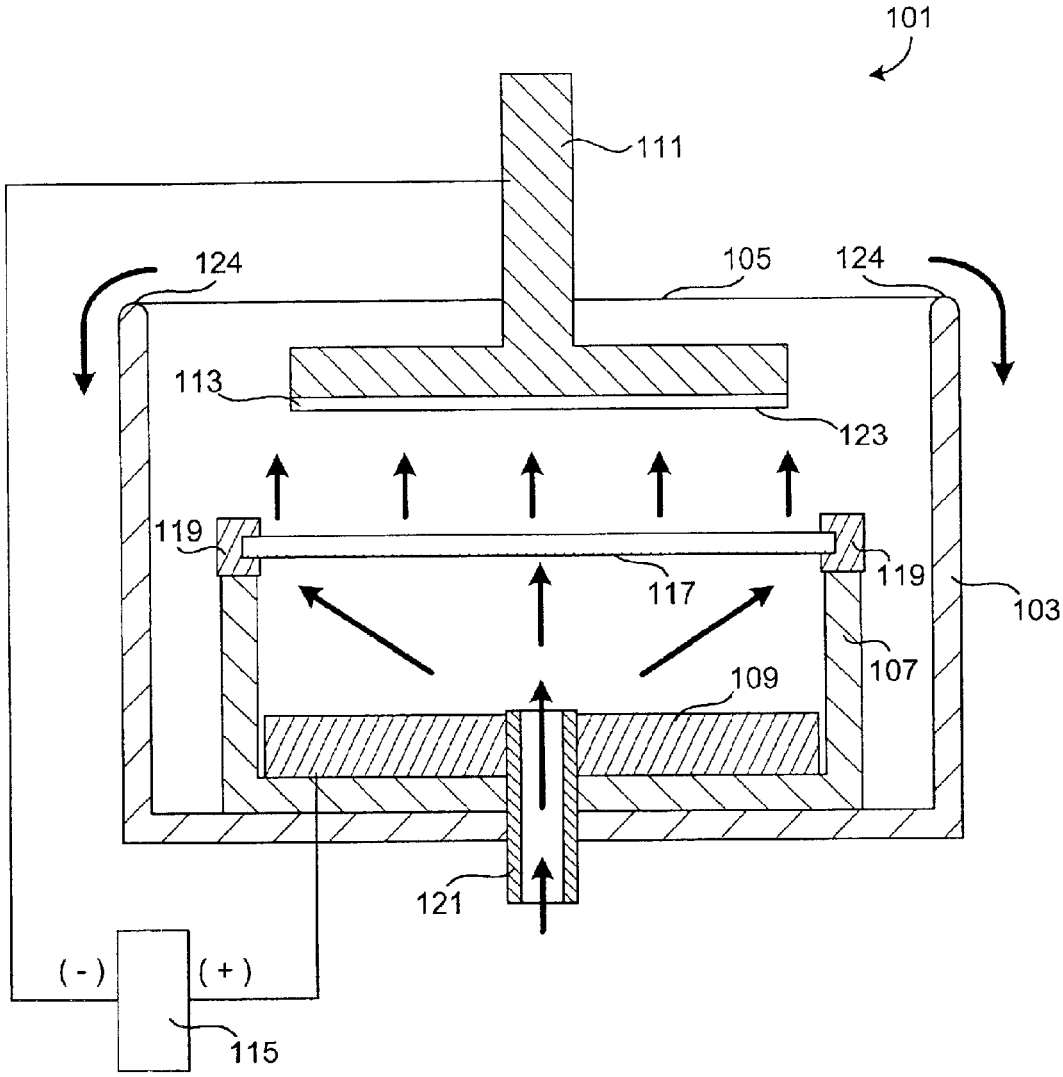
FIG. 1 depicts a cross-sectional simplified diagram of an electroplating apparatus of the invention.

In the following detailed description of the present invention, numerous specific embodiments are set forth in order to provide a thorough understanding of the invention. However, as will be apparent to those skilled in the art, the present invention may be practiced without these specific details or by using alternate elements or processes. For example some methods of the invention are described in terms of copper electroplating, however other electroplating, electroless plating, or even electropolishing systems may be employed. Essentially any metal or other conductive material susceptible to deposition by plating or removal by polishing can be used with this invention. These materials can be deposited or removed on any type of work piece. In some descriptions herein, well-known processes, procedures, and components have not been described in detail so as not to unnecessarily obscure aspects of the present invention.

As mentioned above the invention provides methods and apparatus for controlling plating fluid flow dynamics with respect to a plating surface of a substrate. In particular the invention finds use in the semiconductor industry for plating wafers. The invention achieves fluid control through use of a diffuser membrane.

Also as mentioned, the distribution of the axial component of fluid velocity on the plating surface of a wafer is important to plating uniformity. Plating fluid contacting a rotating wafer during plating has essentially three velocity components with respect to the wafer surface: radial, angular, and axial. The radial velocity component relates to a fluid velocity vector, parallel to the wafer surface and directed from the wafer center toward the wafer outer perimeter. The angular (azimuthal) velocity component relates to a fluid velocity vector parallel and perpendicular to the radical vector. The axial velocity component relates to a fluid velocity vector directed at the wafer surface (normal to the wafer surface). The axial velocity component, which impinges on the wafer surface, correlates well with plating uniformity and thus is the most relevant component of the fluid velocity with respect to plating uniformity. It is the axial velocity component that delivers fresh fluid to the plating surface, the radial component angular components move the fluid around but do not effect convection to the wafer/fluid interface.

Generally, the diffuser membrane is positioned between the work piece upon which plating is to occur and the fluid inlet (such as an aperture or nozzle). Essentially, the only fluid path from the inlet to the work piece is through the diffuser membrane. Thus the diffuser membrane typically spans an entire (or substantially an entire) horizontal slice of a plating cell. More specifically, the effective flow surface of the membrane is larger than the plating surface of the work piece.

The diffuser membrane provides a significant resistance to flow of the fluid provided via the inlet. This resistance to flow distributes the flow across the membrane and thus the axial velocity of the fluid exiting the membrane is substantially uniform across the surface of the membrane.

FIG. 1 depicts a cross-sectional simplified diagram of one embodiment of an electroplating apparatus 101 of the invention. Apparatus 101 has a plating cell 103 that contains electrolyte 105. Inside cell 103 is an anode cup 107 and an anode 109. Apparatus 101 also has a wafer holder 111, which holds a wafer 113. Anode 109 and wafer 113 (the cathode) are electrically coupled to a power source 115. For simplicity, detailed electrical connections are not shown, but wafer 113 is electrically coupled to power source 115 via wafer holder 111. In this case, wafer holder 111 is shown immersed in electrolyte 105, directly above the anode cup. Thus copper metal, for example, forms anode 109 and is plated onto wafer surface 123. The electrochemical reaction is mediated by electrolyte 105, for example a copper sulfate/inorganic acid mixture.

Covering the opening of anode cup 107 is a diffuser membrane 117. Diffuser membrane 117 is affixed to anode cup 107 via support 119. The combination of the anode cup with the diffuser membrane defines an anode compartment. In this case, the anode compartment contains anode 109 and conduit 121. In an alternative design, diffuser membrane 117, again positioned between the anode and cathode, could span the entire width of the interior of plating cell 103, obviating the need for anode cup 107. However, there are advantages to having an anode cup, as will be discussed below.

In this diagram, dark arrows indicate the flow pattern of electrolyte. Recirculating electrolyte enters the anode compartment via conduit 121. Conduit 121 is depicted as a simple open-ended conduit for purposes of illustration. In preferred embodiments, however, there may be specialized nozzles at the electrolyte outlet end of conduit 121 for shaping the flow pattern of the electrolyte in the anode compartment. As depicted, the electrolyte disperses in the anode compartment and then travels through diffuser membrane 117. Diffuser membrane 117 creates a uniform flow of electrolyte directed at wafer surface 123. The electrolyte is deflected by the wafer surface and travels radially outward along the wafer surface. The electrolyte then passes over weir 124 of cell 103 and into a collection device (not shown) for recirculation.

The separation distance between the diffuser membrane and the work piece (wafer) is adjusted such that the plating uniformity ultimately benefits from the uniform flow emanating therefrom. In general this means that the surface of the work piece to be plated is in close proximity to the diffuser membrane. For 200 mm and 300 mm wafers, the separation distance between the diffuser membrane and the work piece is between about 5 and 60 mm. More preferably, between about 10 and 40 mm. In general, the separation distance is about one-fortieth to one-fifth of the work piece's principle dimension (parallel to the membrane). In the case of a wafer, the principle dimension would be the wafer's diameter.

Given the functions of the diffuser membrane, it should allow electrolyte to pass at a flow rate of at least 0.5 ml/second/cm$^2$ (more preferably 1.5 ml/second/cm$^2$) when exposed to a pressure difference of about 2 psi. It should withstand a pressure difference of at least 5 psi, more preferably at least 10 psi.

The diffuser membrane may be constructed from a wide variety of materials. Obviously, the material used to construct the diffuser membrane should be resistant to corrosive plating formulations. Preferably, the material is a microporous non-electrically conductive material such as a sintered plastic, porous ceramic, or sintered glass. The diffuser membrane is preferably made of a material having a pore size of between about 1 and 200 $\mu$m, more preferably between about 5 and 50 $\mu$m. Preferably the material has a void fraction of about 10 to 70%, more preferably about 20 to 40%, and a thickness of between about 0.2 to 2.5 centimeters, more preferably between about 0.5 and 1.0 centimeters.

Examples of suitable microporous plastics for use with as the diffuser membrane include polyethylene, polypropylene, and polysulfone, polyvylidene diflouride (PVDF) and polytetrafluoroethylene (PTFE). A specific example of a diffuser membrane material is a sintered microporous sheet of polyethylene or polypropylene produced by Portex Corporation of Fairburn, Ga. (extra fine to course grade materials).

As explained above, the diffuser membrane creates a sufficient resistance to flow so as to create a uniform flow pattern toward the wafer. The membrane also should not introduce a significant resistance to the passage of ionic current (small voltage drop). The diffuser membrane also acts as a filtering membrane for bubbles and particles which otherwise might approach and become attached to the wafer. Therefore, the diffuser membrane is effective in reducing wafer-plating defects.

Preferably, the total volumetric flow rate of the plating fluid pumped into the anode compartment is between about 3 and 20 liters per minute, more preferably between about 6 and 15 liters per minute. Even more preferably, the total flow rate of the plating fluid is about 12 liters per minute, when the substrate is a 200 millimeter diameter wafer.

Figure 2A:
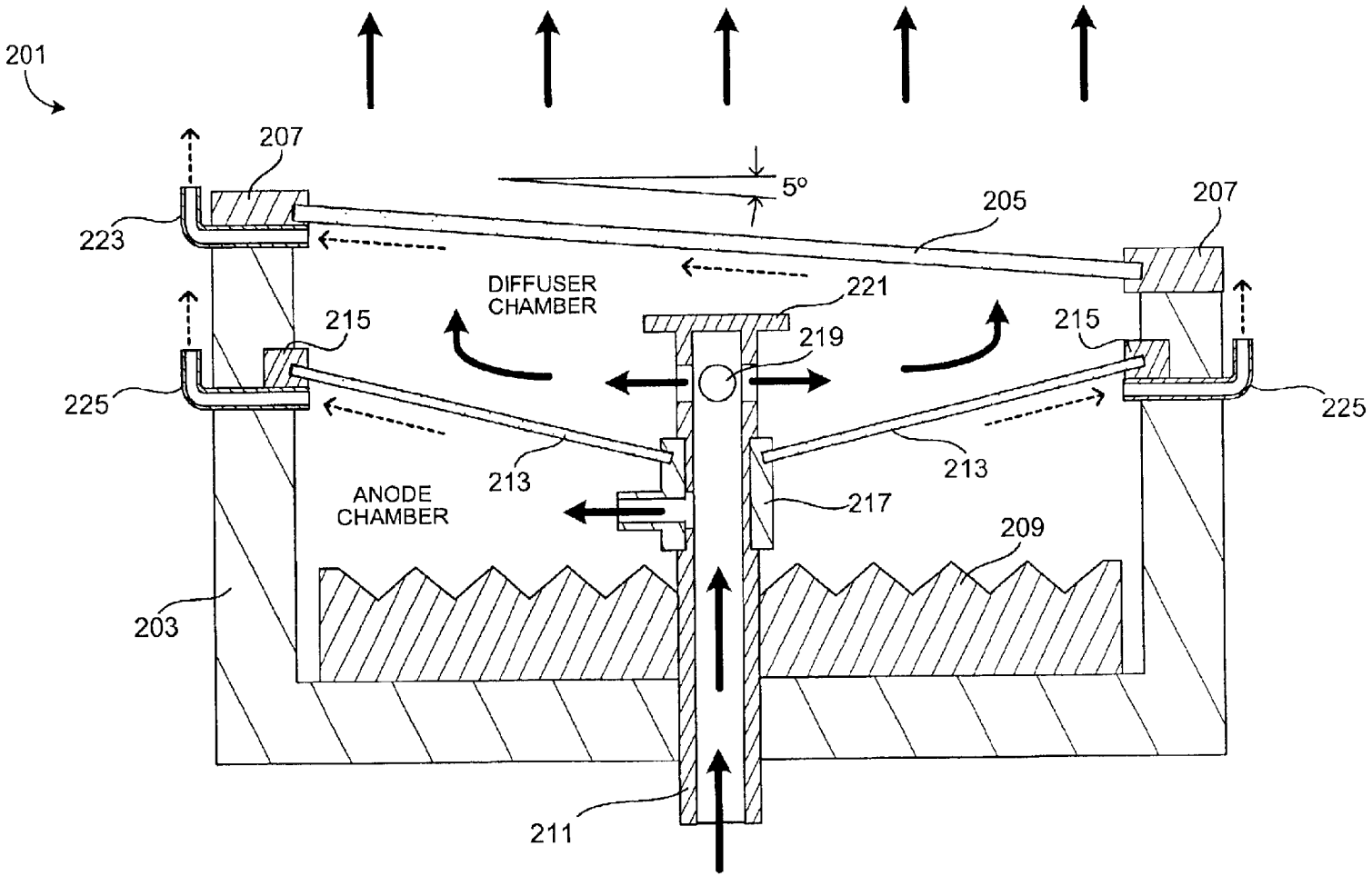
FIG. 2A depicts a cross-sectional simplified diagram of an anode compartment of the invention.

FIG. 2A depicts a cross-sectional simplified diagram of an example of an anode compartment 201 of the invention (associated cathode not shown). Anode compartment 201 has an anode cup 203 and a diffuser membrane 205 affixed to (by support 207) and covering the opening of anode cup 203. At the inside bottom of the anode compartment is an anode 209. Conduit 211 supplies recirculating electrolyte to the anode compartment.

Between anode 209 and diffuser membrane 205 is a porous transport barrier 213, which is supported by supports 215 and 217. Use of transport barrier 213 can overcome anode-mediated degradation of electrolyte additives by separating the electrolyte into a portion associated with the anode and a portion associated with the cathode (termed anolyte and catholyte, respectively). Thus in this case, the anolyte comprises electrolyte contained in the region between anode 209 and transport barrier 213 in the anode cup; this region is termed the anode chamber. The catholyte then, comprises electrolyte above transport barrier 213 up to and including that electrolyte which interacts with the surface of the cathode (not shown). The transport barrier should limit the chemical transport (via diffusion and/or convection) of most species but allow migration of anion and cation species (and hence passage of current) during application of electric fields associated with electroplating. In other words, the transport barrier should limit the free cross-mixing of anolyte and catholyte.

Various materials may be used in the transport barrier. Examples include porous glasses, porous ceramics, silica aerogels, organic aerogels, porous polymeric materials, and filter membranes. In a preferred embodiment, the transport barrier is made from a sintered polyethylene or a sintered polypropylene. In a specific embodiment, the apparatus includes a carbon filter layer that is substantially coextensive with the transport barrier. The carbon filter layer can filter non-ionic organic bath additives from a catholyte that manage to pass through the transport barrier toward the anode chamber. A complete description of the transport barrier is described in U.S. patent application 09/706,272, which was previously incorporated by reference.

The region between transport barrier 213 and diffuser membrane 205 is termed the diffuser chamber. Conduit 211 is designed to divert plating fluid flow exiting the conduit away from the plating surface of the substrate. In this case, apertures 219 in the sides of conduit 211 achieve this goal. Additionally, the end of conduit 211 is capped with a "mushroom-shaped" nozzle 221, to better divert and distribute the flow on a path normal to the plating surface of the wafer. Those skilled in the art would recognize other fluid diversion designs. Diversion of the plating fluid from a path directed at the wafer is done to facilitate the diffuser membrane in creating a uniform flow pattern in the plating fluid as it exits the diffuser membrane. Thus a centralized strong flow aimed at the diffuser membrane is to be avoided, in this case. As well, support 217 is designed to allow a portion of the electrolyte to flow directly into the anode chamber.

As depicted by the heavy arrows, electrolyte enters the anode compartment via conduit 211. A portion of the flow is diverted into the anode chamber via 217, and the remaining portion flows through apertures 219. In a preferred embodiment, the portion of the total plating fluid flow diverted into the anode chamber is between about 5 and 20 percent. In an even more preferred embodiment, the portion of the total plating fluid flow diverted into the anode chamber is about 10 percent. The electrolyte then passes through diffuser membrane 205 and exits with a uniform flow pattern for interaction with the wafer (cathode).

In this embodiment, diffuser membrane 205 is tilted from horizontal, where a horizontal orientation can be described by a plane which defines the surface of an electrolyte in a cell where 201 is used. Preferably, the angle of tilt is between about 2 and 6 degrees from horizontal. More preferably, the angle of tilt is about 5 degrees from horizontal, as indicated in FIG. 2A. Positioned inside the diffuser chamber at the highest point below diffuser membrane 205 is a bubble removal path 223. Bubbles that enter the diffuser chamber do not pass through the membrane, but rather move along its tilted inner surface (due to their buoyancy) and exit the chamber via 223. As well, the anode chamber has a plurality of bubble removal paths 225, positioned inside the anode chamber at the highest points below tilted transport barrier 213. In the latter case, transport barrier 213 is designed so that bubbles are directed toward paths 225. Effective fluid pressure in the anode compartment is maintained (with respect to the bubble removal paths) because tubes connected to 223 and 225 are small enough to provide sufficient resistance to fluid flow, but allow bubbles to flow due to the bubble's buoyancy.

Figure 2B:
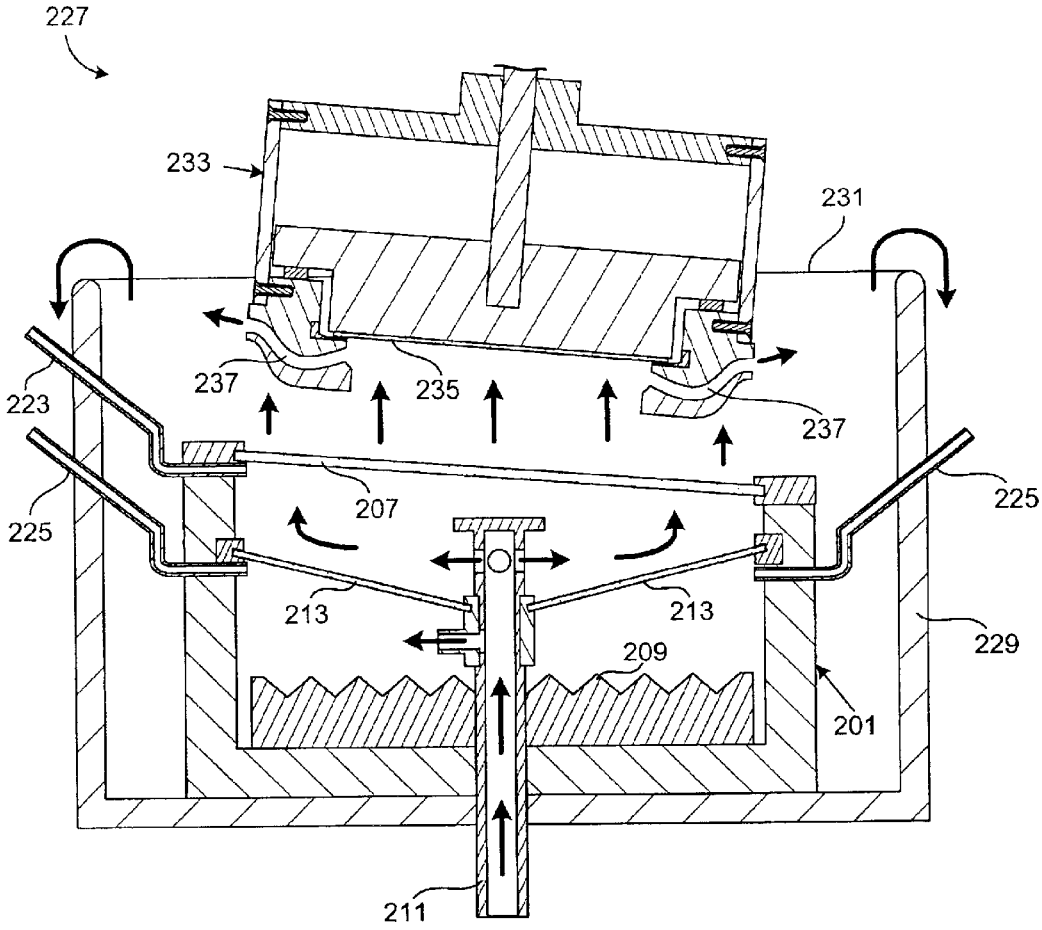
FIG. 2B is a more detailed diagram of a particular electroplating apparatus of the invention.

FIG. 2B is a more detailed diagram of a particular example of an electroplating apparatus 227 of the invention, which utilizes anode compartment 201 (from FIG. 2A). Depicted is an electroplating cell 229, which contains electrolyte 231. Anode compartment 201 (shown in less detail as in FIG. 2A) is located in cell 229, submerged in electrolyte 231. Also shown is a wafer holder 233, in this case a Clamshell apparatus as described in U.S. Provisional Patent Application No. 60/295,245 (Attorney Docket No. NOVLP020) filed on May 31, 2001. Wafer holder 233 has the ability to change the angle that wafer 235 is positioned with respect to horizontal. Thus the wafer holder can immerse wafer 235 into electrolyte 231 at an angle and in this case, hold the planar plating surface of the wafer parallel to diffuser membrane 207 during plating. As depicted in FIG. 2B, electrolyte 231 is presented to wafer 235 in a uniform flow pattern. After contacting the wafer surface, the electrolyte is deflected by the wafer surface and travels radially outward along the wafer surface. Wafer holder 233 provides a flow path 237 through which the electrolyte can flow, minimizing edge defects related to turbulant flow characteristics at the wafer's edge. Only a cross-section of flow path 237 is shown. Flow path 237 is radially symmetric about an axis normal to the center of wafer 235, thus as wafer holder 233 rotates, flow path 237 maintains the cross-sectional profile illustrated. Additionally, flow path 237 allows for efficient removal of bubbles that travel to the immediate area of the wafer during plating. Having the wafer tilted, as depicted, facilitates bubble removal due to the buoyancy of bubbles. Rather than remaining on the wafer surface, bubbles can travel along the wafer surface and exit at the higher portion of flow path 237.

Thus, anode compartment 201 and clamshell 233 are designed as complimentary components of an electroplating apparatus. Each has (or can achieve) unique tilted surfaces for guiding bubbles away from the wafer surface, coupled with bubble removal paths. Additionally, anode compartment 201 is designed to present a uniform flow pattern of electrolyte to wafer 235, and in turn, clamshell 233 is designed to accommodate the flow pattern and facilitate free flow of electrolyte at the wafer edge region via flow path 237, both for optimum plating performance.

The flow in plating cell 229 with utilizing diffuser membrane is significantly different than with an impinging jet nozzle. A uniform flow across the wafer results. A matching of the upwardly directed flow and the induced flow patterns associated with wafer rotation, to achieve the optimum plating uniformity, has been achieved. Preferably rotation rates of between about 25 and 250 rpm are used. More preferably rotation rates of between about 50 and 150 rpm are used. Coupled with these rotation rates are preferred flow velocities (flow across the diffuser membrane). When a rotation of between about 25 and 250 rpm is used, a flow velocity of between about 0.2 and 1.4 cm/sec is provided. More preferably, when a rotation of between about 50 and 150 rpm is used, a flow velocity of between about 0.4 to 0.9 cm/sec is provided. The flows approximately match the natural upward flow induced by the rotation of the wafer itself, but replace the rotating fluid with fluid having no rotational inertia. Such a set of conditions eliminates the propensity for convection cells to develop and plating swirl patterns to form.

Upon initialization of a system using anode compartment 201, electrolyte is pumped into the system; transport barrier 213 and diffuser membrane 207 are wetted with electrolyte. Once wetted, they serve their intended functions as described. As indicated in FIG. 2A, the intended flow path of recirculating electrolyte is in a forward direction entering at conduit 211 and exiting diffuser membrane 207. It may take several minutes to flush the system of bubbles during an initial startup.

In some cases, the electroplating system may have to be shut down temporarily. When this happens, it is advantageous to keep transport barrier 213 and diffuser membrane 207 wetted with electrolyte. If the membranes are kept submerged in the electrolyte, the time required for flushing bubbles from the system is minimized because the anode compartment remains bubble-free during the down time. Additionally, if diffuser membrane 207 and transport barrier 213 are allowed to dry out, salt components of the electrolyte can crystallize in the membranes causing damage to the membranes or reducing their respective permeabilities. If crystals form in and around the membranes, a time-consuming removal of the salts via flushing procedures or membrane replacement may be necessary. In order to avoid these problems an isolation valve is utilized.

Figure 2C:
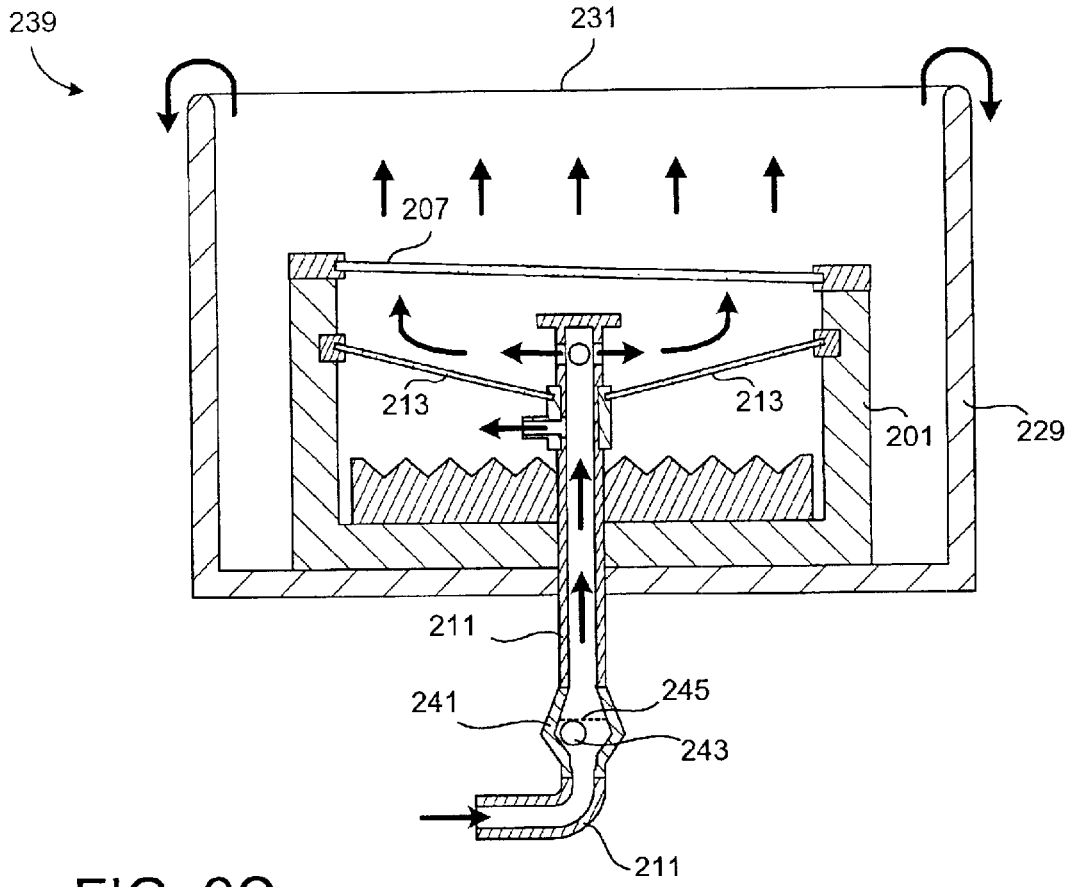
FIGS. 2C–D depict function of a cell isolation valve component of one embodiment of the invention.
Figure 2D:
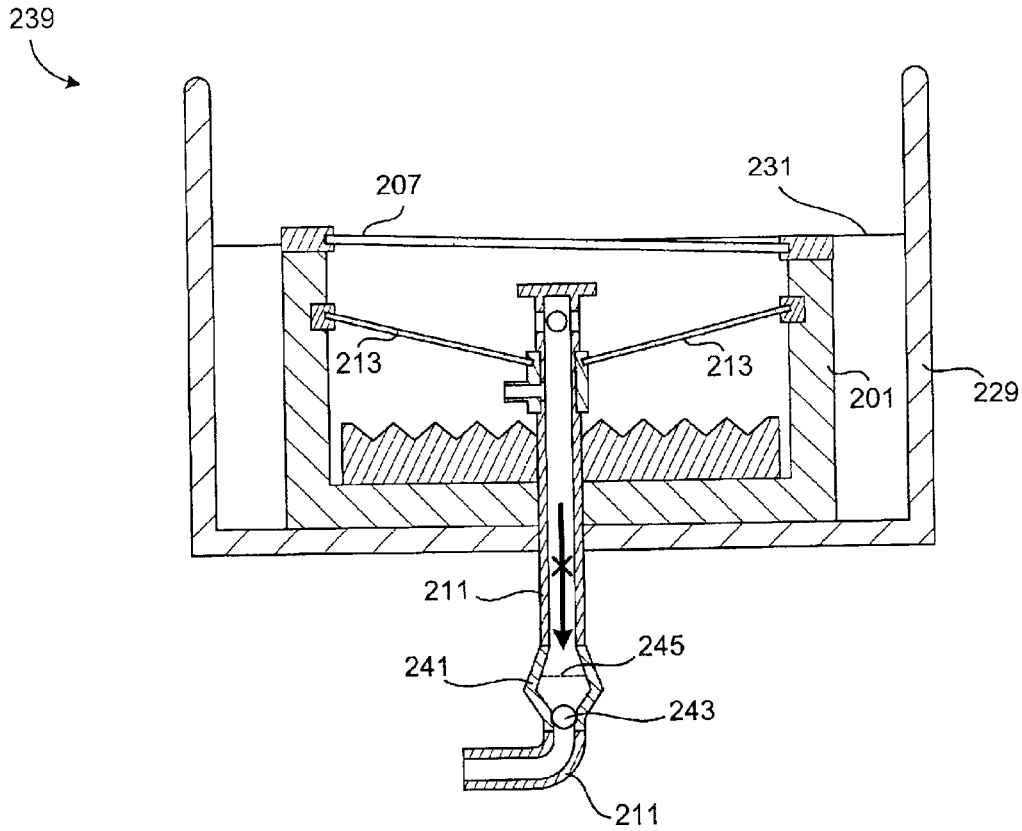

FIGS. 2C and 2D depict function of a cell isolation valve component used in conjunction with anode compartment 201. FIG. 2C shows plating cell 229 with anode compartment 201 as depicted in previous figures. Again, dark arrows indicate the electrolyte flow pattern during plating. In this case, one example of an isolation valve is shown in line with conduit 211. The isolation valve has a body 241, a screen 245, and a valve ball 243. During plating, when electrolyte is flowing in the "forward" direction (as in FIG. 2C), valve ball 243 is lifted by the electrolyte flow and rests against screen 245. Thus electrolyte is allowed to freely flow through conduit 211 (via permeable screen 245) in the forward direction. As depicted in FIG. 2D, when the circulation system is turned off, electrolyte is not allowed to flow "backwards" through conduit 211. Since there is no forward flow, valve ball 243 falls to the bottom of valve body 241 where it blocks the opening. Thus, as illustrated in FIG. 2D, electrolyte 231 may be removed to a level equal to the height of anode chamber 201. Thus diffuser membrane 207 and transport barrier 213 stay wetted with electrolyte. The cell isolation valve may take other forms than that described herein. One skilled in the art would recognize other configurations and designs for such one-way flow valves, taking into consideration that the materials used must be resistant to corrosive plating mixtures.

Having diffuser membrane 207 covering the opening of anode chamber 201 also has the advantage that particulates (from a broken wafer for example) do not enter the anode chamber or the circulation system, e.g. conduit 211. During such situations, plating cell 229 can be partially drained as in FIG. 2D, and particulates removed from plating cell 229 without drying out diffuser membrane 207 or transport barrier 213.

EXAMPLES

Example 1

Modeling studies have shown that the flow from the top hole of an anode chamber flow nozzle impinges on the wafer in a jet-like fashion. This correlates with experimental data in which deposited films are thicker in the wafer center. Accordingly, the geometry of the top hole in such impinging nozzles was modified in several ways to see how such modifications effect the jet width and intensity at the wafer surface.

Figure 3:
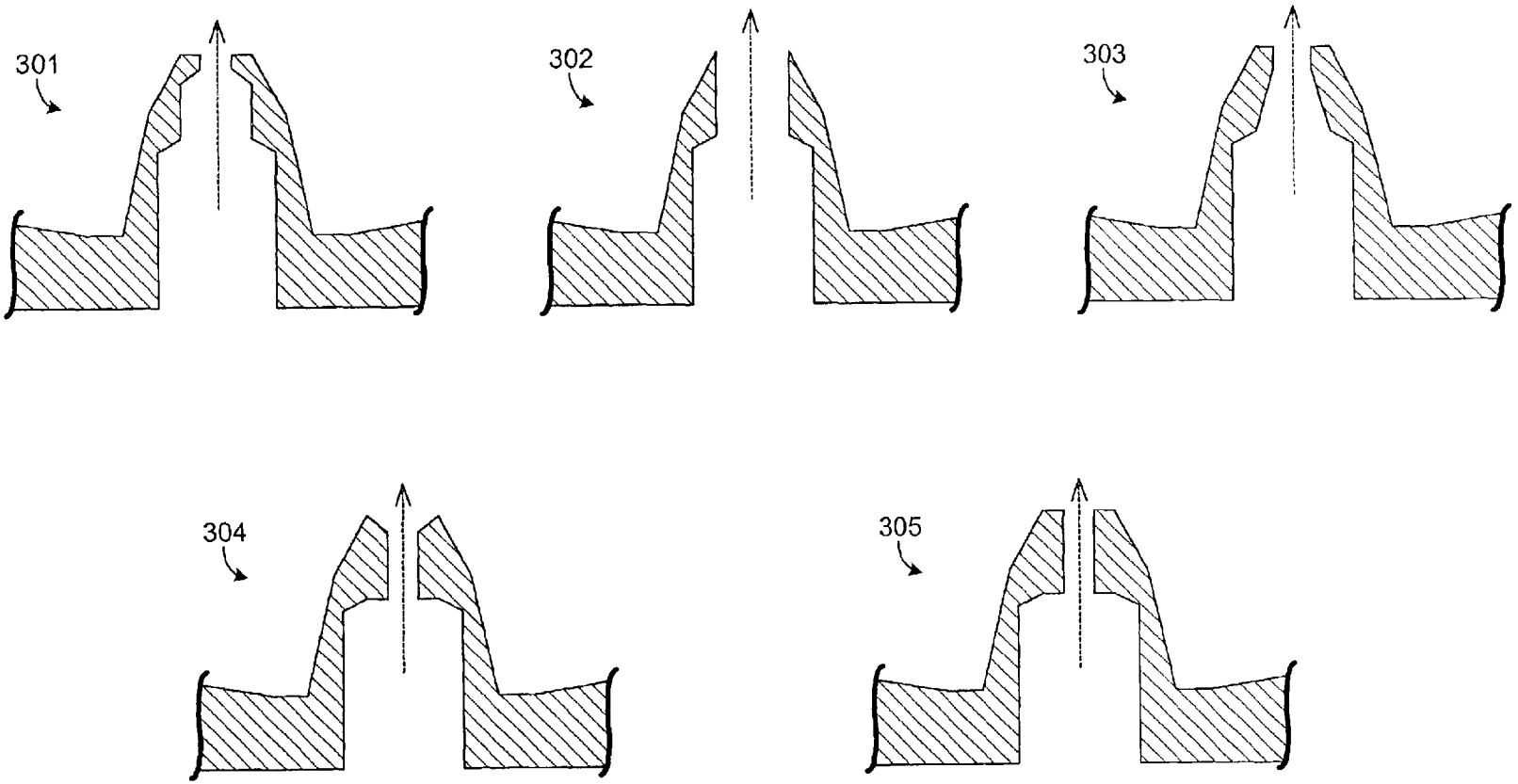
FIG. 3 depicts flow nozzle designs for electroplating cells.

The five hole geometries modeled are shown in FIG. 3. FIG. 3 illustrates cross-sectional views of the following nozzle top hole geometries: 301, standard hole; 302, wide hole; 303, sloped hole; 304, flared hole; and 305, high aspect ratio hole. The dotted arrows indicated the direction of flow. To simplify analysis, side holes were closed in these models and the flow through the top was fixed at 8% of 6 liters/min. In this way the flow through each top hole would be the same as for a standard nozzle.

The realizable k-$\epsilon$ turbulence model was used in all cases with 2% inlet turbulence intensity. With turbulence on, these models proved difficult to converge. In particular, the pressure residual (a measure of error) would not come down. Convergence was finally attained by running the models as transient problems. It turned out that the fully converged solution matched very closely to the steady state solutions in which all residuals except pressure were converged. So steady state runs were then used.

Figure 4:
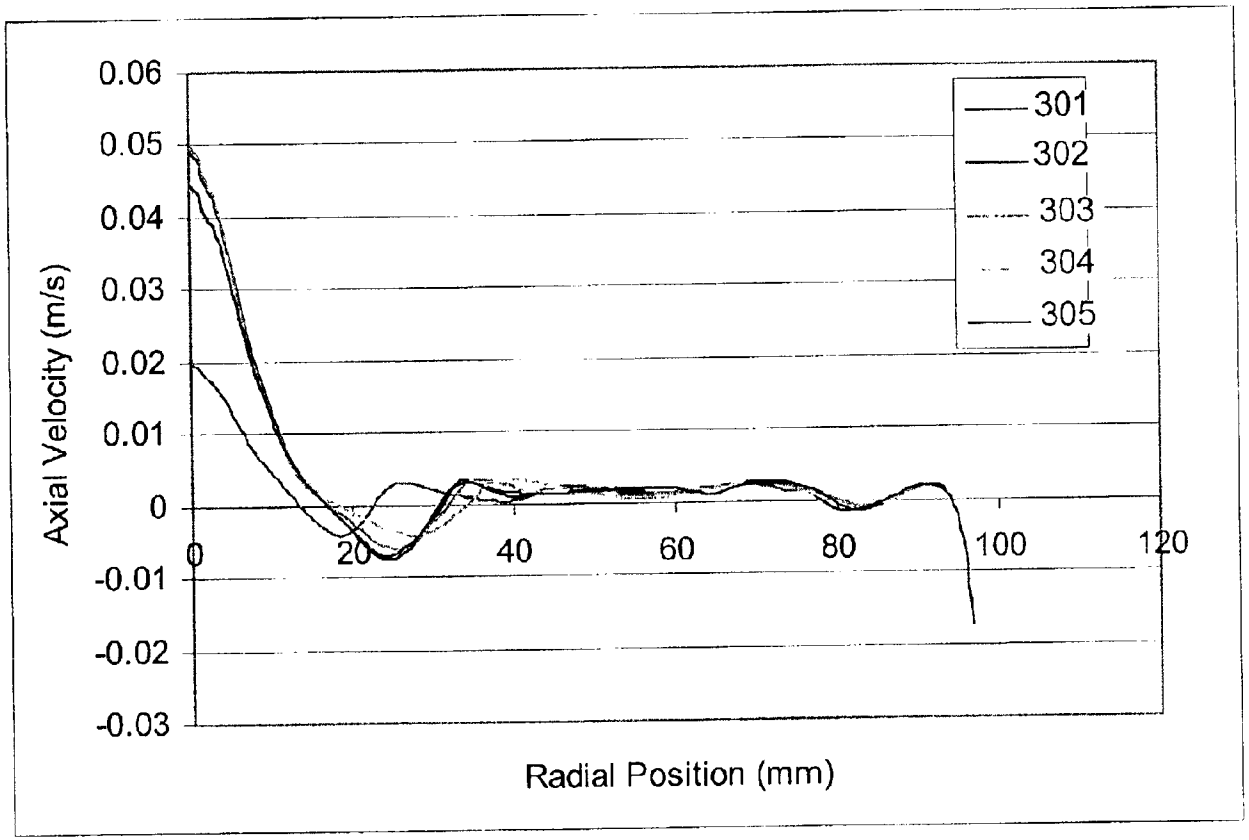
FIG. 4 depicts axial flow velocities produced by the nozzles with designs as depicted in FIG. 3.

The axial component of fluid velocity 1 mm from the wafer is plotted in FIG. 4. This shows the intensity of the top hole jet near the wafer surface for the different cases. Except for 302, all of the models show a large jet of fluid, about 15 mm in radius impinging on the wafer. This suggests that flaring or changing the aspect ratio of the hole has no major effect. The 302 case, in which the hole was increased from 0.120" in diameter to 0.281", showed a large drop in the jet velocity, although the width is similar.

Figure 5:
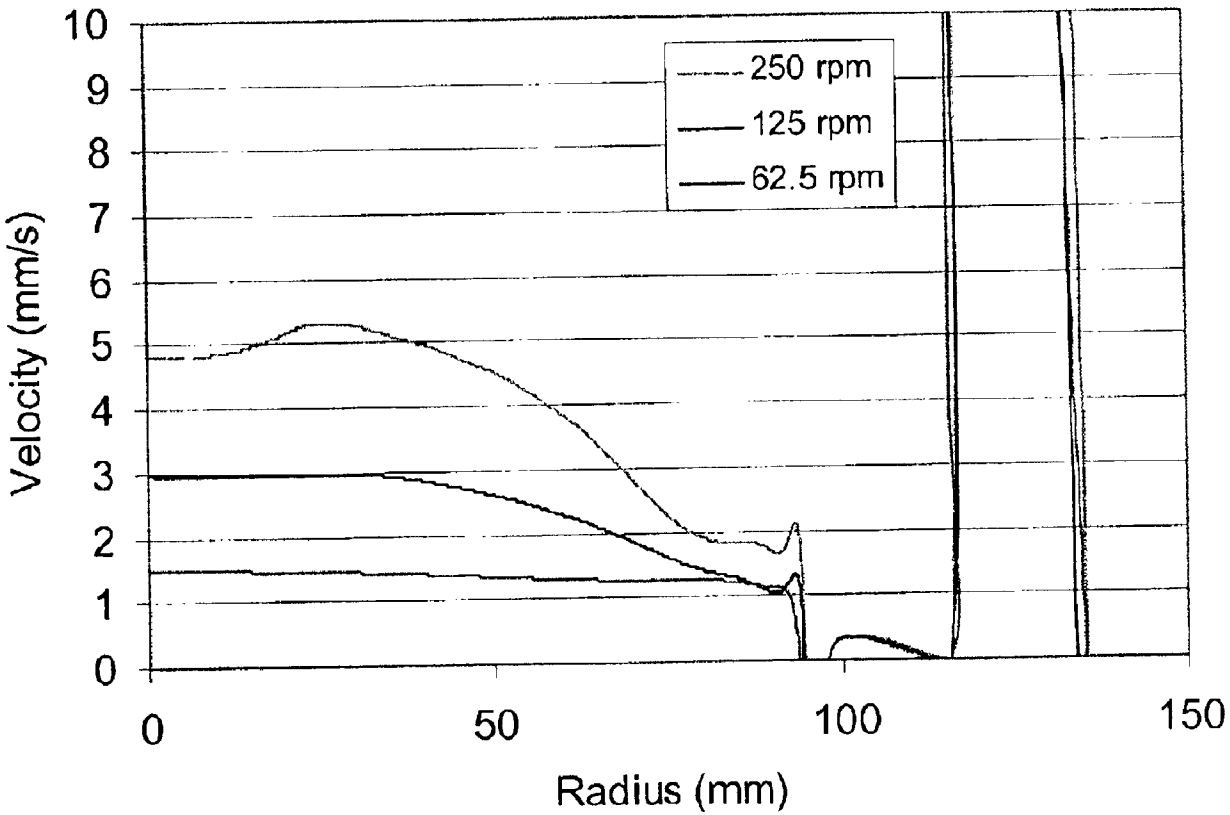
FIG. 5 shows the axial flow velocity near the wafer surface with rotation only (no flow nozzle on).

FIG. 5 shows the axial flow velocity near the wafer surface with rotation only (no nozzle flow on). The axial velocity at the center is approximately 10 times greater with the nozzle flowing at 6 lpm than with no nozzle flow at all (compare to FIG. 4). Therefore, while an impinging nozzle is effective in removing a center bubble from a horizontally oriented wafer, it substantially changes the conditions of plating at the center and adversely effects plating uniformity.

Tests were performed where the center flow was turned off, or diverted from impacting the wafer, shortly (5–10 seconds) after plating began. These test shows that changes in plating rate often remain even after the flow was reduced (a hysteresis effect). These results indicated that a method of removing the center bubble, which did not involve a non-uniform flow, was required (e.g. the wafer-tilting capability of the clamshell).

Example 2

Figure 6:
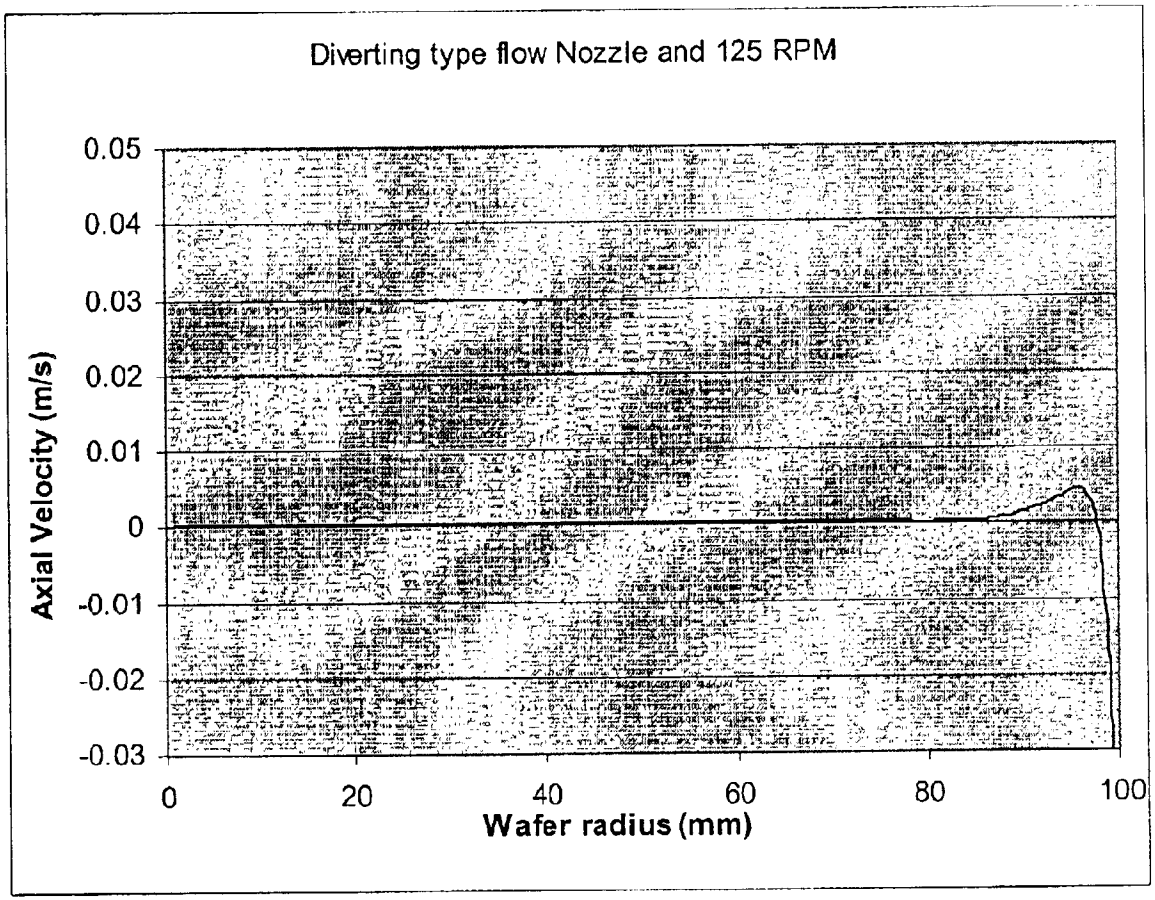
FIG. 6 shows a model of uniform flow achieved with a diverting-type nozzle design.

FIG. 6 shows the highly uniform flow (model) achieved 1 mm from wafer surface when a diverting type nozzle, a diffuser membrane, and a slotted design clamshell with a flow path as described in FIG. 2B are used in combination. In this case, the wafer "sees" a highly uniform flow velocity across the wafer surface, with only a minimal change near the radius limit.

Example 3

Figure 7:
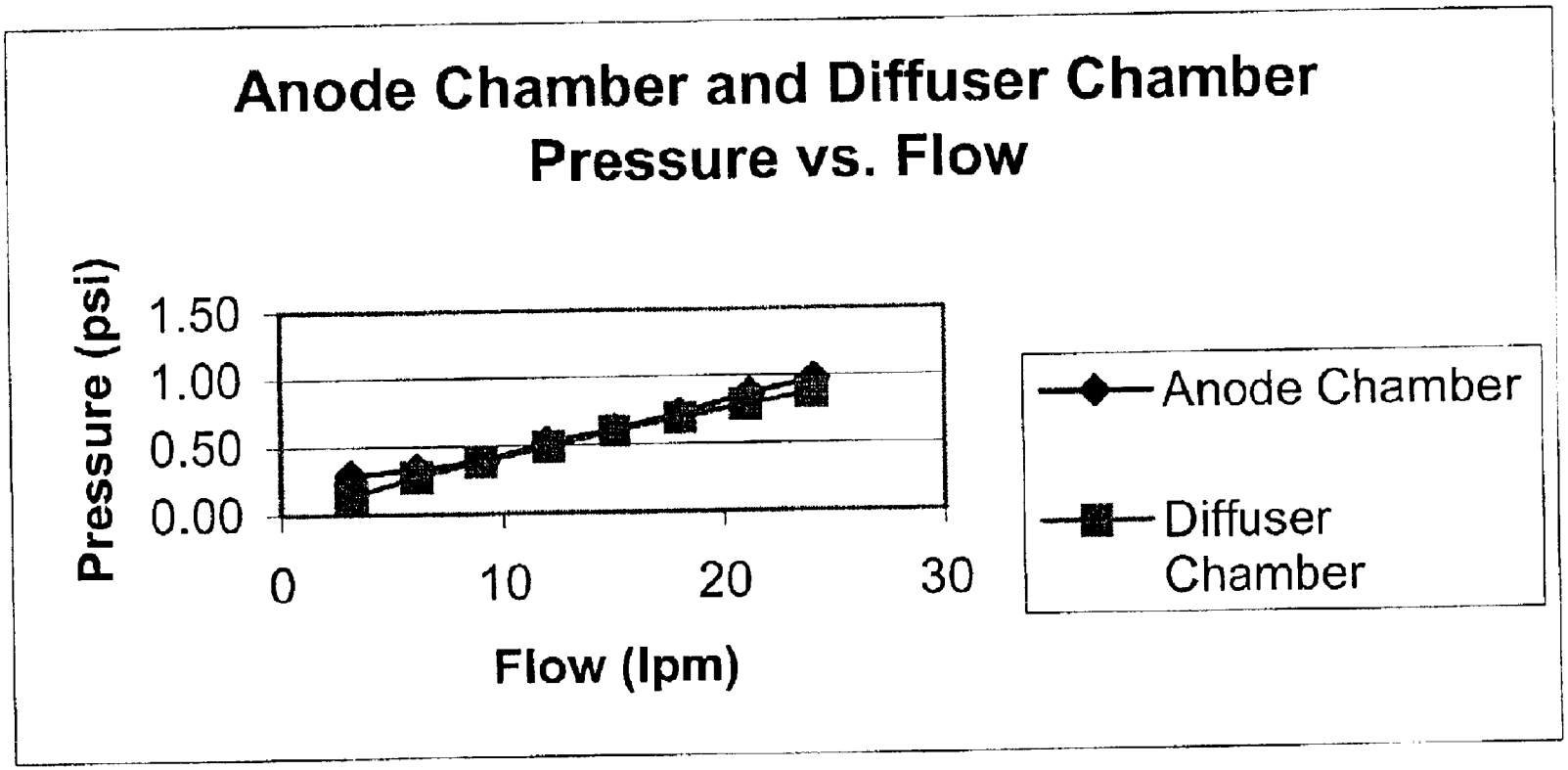
FIG. 7 shows a graph of fluid pressure vs. flow rate in the anode chamber and the diffuser chamber.

FIG. 7 shows a graph of pressure vs. flow rate in the anode chamber and the diffuser chamber. The graph shows actual data recorded using an anode compartment as described in FIG. 2B. The diffuser membrane was made of a sintered polyethylene produced by Portex Corporation of Fairburn, Ga. (extra fine to course grade materials). The diffuser membrane used was approximately ⅛ inch thick. The data shows that there is a measurable pressure differential between the anode chamber and the diffuser chamber.

While this invention has been described in terms of a few preferred embodiments, it should not be limited to the specifics presented above. Many variations on the above-described preferred embodiments may be employed.

Therefore, the invention should be broadly interpreted with reference to the following claims.

What is claimed is:

1. An apparatus for plating a metal onto a substrate, the apparatus comprising:

a plating cell;

an aperture disposed within said plating cell for delivering a plating fluid onto the plating surface of a work piece; and a diffuser membrane disposed within said plating cell such that the plating fluid emanating from the aperture must pass through said diffuser membrane before contacting the work piece;

wherein the diffuser membrane is made of a material having a pore size of between about 1 to 200 $\mu$m and creates a flow pattern such that the plating fluid exits the diffuser membrane at substantially the same velocity across the entire surface of the diffuser membrane.

2. The apparatus of claim 1, wherein the plating cell is an electroplating cell.

3. The apparatus of claim 2, further comprising:

a cathode electrical connection that can connect to the work piece and apply a potential, allowing the work piece to become a cathode; and an anode electrical connection that can connect to an anode and apply an anodic potential to the anode;

wherein the diffuser membrane is between the anode and the cathode.

4. The apparatus of claim 1, wherein the diffuser membrane is made of a material having a pore size of between about 5 to 50 $\mu$m.

5. The apparatus of claim 1, wherein the material is a non-conductive microporous material selected from the group consisting of sintered plastic, porous ceramic, or sintered glass.

6. The apparatus of claim 5, wherein the microporous plastic is selected from the group consisting of polyethylene, polypropylene, polysulfone, polyvylidene diflouride (PVDF), and polytetrafluoroethylene (PTFE).

7. The apparatus of claim 5, wherein the material is between about 0.2 to 2.5 cm thick.

8. The apparatus of claim 5, wherein the material is between about 0.5 to 1.0 cm thick.

9. The apparatus of claim 5, wherein the material has a pore volume of between about 10 and 70 percent.

10. The apparatus of claim 5, wherein the material has a pore volume of between about 20 and 40 percent.

11. An apparatus for plating a metal onto a substrate, the apparatus comprising:

an electroplating cell;

an aperture disposed within said plating cell for delivering a plating fluid onto the plating surface of a work piece;

a diffuser membrane disposed within said plating cell such that the plating fluid emanating from the aperture must pass through said diffuser membrane before contacting the work piece;

a cathode electrical connection that can connect to the work piece and apply a potential, allowing the work piece to become a cathode;

a anode electrical connection that can connect to an anode and apply an anodic potential to the anode;

wherein the diffuser membrane is between the anode and the cathode and creates a flow pattern such that the plating fluid exits the diffuser membrane at substantially the same velocity across the entire surface of the diffuser membrane; and an anode cup, wherein the anode and the aperture are disposed in said anode cup and the diffuser membrane covers the opening of the anode cup; the anode cup and diffuser membrane defining an anode compartment in the electroplating cell.

12. The apparatus of claim 11, wherein the total volumetric flow rate of the plating fluid pumped into the anode compartment is between about 3 and 20 liters per minute.

13. The apparatus of claim 11, wherein the total volumetric flow rate of the plating fluid pumped into the anode compartment is between about 6 and 15 liters per minute.

14. The apparatus of claim 11, wherein the total volumetric flow rate of the plating fluid pumped into the anode compartment is about 12 liters per minute, when the substrate is a 200 millimeter diameter wafer.

15. The apparatus of claim 11, wherein the anode compartment is submerged in an electrolyte bath and the diffuser membrane is planar and tilted by a non-zero tilt angle with respect to a plane defining the surface of the electrolyte in the bath.

16. The apparatus of claim 15, wherein the tilt angle is between about 2 and 6 degrees from horizontal.

17. The apparatus of claim 15, wherein the tilt angle is about 5 degrees from horizontal.

18. The apparatus of claim 15, further comprising a mechanism for holding a planar plating surface of the work piece parallel to the diffuser membrane during plating.

19. The apparatus of claim 15, further comprising a mechanism for rotating the work piece during plating.

20. The apparatus of claim 15, further comprising a bubble removal path positioned inside the anode compartment proximate to the inner surface of the diffuser membrane such that bubbles flow along the inner surface of the diffuser membrane and exit the anode compartment through said bubble removal path.

21. The apparatus of claim 11, wherein the aperture is configured to divert the flow of plating fluid exiting the aperture away from the plating surface of the work piece.

22. The apparatus of claim 20, wherein the aperture is a mushroom-shaped delivery nozzle.

23. The apparatus of claim 11, wherein the flow rate across the diffuser membrane surface is at least 0.5 ml/second/cm$^2$ when exposed to a pressure difference of about 2 psi.

24. The apparatus of claim 11, wherein the flow rate across the diffuser membrane surface is at least 1.5 ml/second/cm$^2$ when exposed to a pressure difference of about 2 psi.

25. The apparatus of claim 11, wherein the diffuser membrane can withstand a pressure difference of at least 5 psi.

26. The apparatus of claim 11, wherein the diffuser membrane can withstand a pressure difference of at least 10 psi.

27. The apparatus of claim 11, further comprising a porous transport barrier, disposed between the anode and the diffuser membrane, defining an anode chamber, between the anode and the porous transport barrier, within the anode compartment and a diffuser chamber, between the diffuser membrane and the porous transport barrier, within the anode compartment; wherein the porous transport barrier allows migration of ionic species, including metal ions, between the anode chamber and diffuser chamber, while substantially preventing non-ionic organic bath additives from entering into the anode chamber.

28. The apparatus of claim 27, wherein the transport barrier comprises a material selected from the group consisting of porous glasses, porous ceramics, silica areogels, organic aerogels, porous polymeric materials, and filter membranes.

29. The apparatus of claim 27, wherein the transport barrier comprises sintered polyethylene or sintered polypropylene.

30. The apparatus of claim 27, further comprising a carbon filter layer that is substantially coextensive with the transport barrier, which carbon filter layer can filter nonionic organic bath additives from plating fluid passing through the transport barrier to the anode chamber.

31. The apparatus of claim 27, wherein the aperture diverts a portion of the total plating fluid flow into the anode chamber and the remaining portion into the diffuser chamber.

32. The apparatus of claim 31, wherein the portion of the total plating fluid flow diverted into the anode chamber is between about 5 and 20 percent.

33. The apparatus of claim 32, wherein the portion of the total plating fluid flow diverted into the anode chamber is about 10 percent.

34. The apparatus of claim 27, wherein the anode compartment is submerged in an electrolyte bath and the transport barrier has at least one portion of its surface tilted with respect to a plane defining the surface of the electrolyte in the bath.

35. The apparatus of claim 34, further comprising at least one bubble removal path positioned inside the anode chamber proximate to the inner surface of the transport barrier, such that bubbles flow along the inner surface of the transport barrier and exit the anode chamber through said at least one bubble removal path.

36. The apparatus of claim 27, further comprising an isolation valve for protecting against the plating fluid level dropping below the diffuser membrane and the transport barrier.

37. A method for providing a substantially uniform flow of a plating fluid to the plating surface of a wafer during plating, the method comprising:

providing a compartment fitted with a diffuser membrane made of a material having a pore size of between about 1 to 200 $\mu$m;

pumping the plating fluid into said compartment such that the plating fluid exits the compartment through the diffuser membrane at substantially the same velocity across the entire surface of the diffuser membrane; and holding the plating surface of the wafer in close proximity to the diffuser membrane during plating.

38. The method of claim 27, wherein the diffuser membrane is made of a material having a pore size of between about 5 to 50 $\mu$m.

39. The method of claim 28, wherein the material is a microporous material selected from the group consisting of sintered plastics, ceramics, and sintered glasses.

40. The method of claim 39, wherein the microporous plastic is selected from the group consisting of polyethylene, polypropylene, polysulfone, polyvylidene diflouride (PVDF), and polytetrafluoroethylene (PTFE).

41. The method of claim 29, wherein the material is between about 0.2 to 2.5 cm thick.

42. The method of claim 39, wherein the material is between about 0.5 to 1.0 cm thick.

43. The method of claim 39, wherein the material has a pore volume of between about 10 and 70 percent.

44. The method of claim 39, wherein the material has a pore volume of between about 20 and 40 percent.

45. The method of claim 39, wherein the total volumetric flow rate of the plating fluid is between about 3 and 20 liters per minute.

46. The method of claim 39, wherein the total volumetric flow rate of the plating fluid is between about 6 and 15 liters per minute.

47. The method of claim 39, wherein the total volumetric flow rate of the plating fluid is about 12 liters per minute for a 200 millimeter diameter wafer.

48. The method of claim 39, wherein the compartment is an anode compartment and electroplating is the plating method used.

49. The method of claim 48, wherein the anode compartment is submerged in a plating bath and the diffuser membrane is tilted with respect to a plane defining the surface of the plating fluid in the plating bath.

50. The method of claim 49, wherein the plating surface of the wafer is held parallel to the diffuser membrane during plating.

51. The method of claim 50, wherein the wafer is rotated during plating.

52. The method of claim 51, wherein the wafer is rotated at between about 25 and 250 rpm.

53. The method of claim 51, wherein the wafer is rotated at between about 50 and 150 rpm.

54. The method of claim 52, wherein the flow velocity across the diffuser membrane is between about 0.2 and 1.4 cm/sec.

55. The method of claim 53, wherein the flow velocity across the diffuser membrane is between about 0.4 and 0.9 cm/sec.

56. The method of claim 37, wherein holding the plating surface of the wafer in close proximity to the diffuser membrane means having a separation distance between the plating surface and the diffuser membrane of between about 5 and 60 millimeters.

57. The method of claim 56, wherein the separation distance is between about 10 and 40 millimeters.

58. The method of claim 37, wherein holding the plating surface of the wafer in close proximity to the diffuser membrane means having a separation distance between the plating surface and the diffuser membrane that measures between about $1/40^{th}$ and $1/5^{th}$ of the diameter of the wafer.

* * * * *